US005667072A

United States Patent [19]

Chang

[11] Patent Number: 5,667,072

[45] Date of Patent: Sep. 16, 1997

[54] ELECTRIC DEVICE PACKAGING SET

[75] Inventor: Pi-Chun Chang, Taoyuan, Taiwan

[73] Assignee: Acer Peripherals, Inc., Taoyuan, Taiwan

[21] Appl. No.: 639,863

[22] Filed: Apr. 26, 1996

[51] Int. Cl.[6] ..... B65D 81/02

[52] U.S. Cl. ..... 206/523; 206/320; 206/576

[58] Field of Search ..... 206/523, 524, 206/525, 223, 320, 576, 593, 594, 731, 734

[56] References Cited

U.S. PATENT DOCUMENTS

| | | | |
|---|---|---|---|
| 2,025,153 | 12/1935 | Byrd | 206/731 |
| 2,627,972 | 2/1953 | Roos | 206/731 |
| 4,669,001 | 5/1987 | Thrush | 206/320 |
| 4,762,226 | 8/1988 | Gatton | 206/320 |
| 4,957,202 | 9/1990 | Yoshiki et al. | 206/734 |
| 5,058,745 | 10/1991 | Warner et al. | 206/523 |

*Primary Examiner*—Paul T. Sewell
*Assistant Examiner*—Luan K. Bui
*Attorney, Agent, or Firm*—The Kline Law Firm

[57] ABSTRACT

This invention relates to the design of a packaging set for packing an electric device and its accessories. The packaging set comprises a rectangular cushion block for packing and protecting the electric device, a rectangular carton tightly packed outside the cushion block for protecting the cushion block, one packing slot installed in the cushion block for packing accessories of the electric device and an L-shaped side cover for sealing the slot opening of the packing slot. The side cover can be repeatedly closed and opened for accessing the accessories without damaging the packaging set.

2 Claims, 2 Drawing Sheets

ELECTRIC DEVICE PACKAGING SET

BACKGROUND OF THE INVENTION

1. Field of the Invention

This invention relates to electric device packaging, and more particularly, to a packaging set for packing an electric device and its accessories.

2. Description of the Prior Art

Electric device packaging is very important in providing adequate protection to a new electric device. An electric device packaging set usually comprises a paper carton with a cushion block packed inside for packing and protecting an electric device. The cushion block usually comprises two matching pieces specially designed for clamping a specific electric device and its accessories in between so that they can be well protected by the cushion block and carton. The whole packaging set is tightly sealed after the electric device and its accessories are packed inside and it is quite difficult to take anything out of it if the packaging set is already sealed.

Such packaging design usually cause a problem to electric device vendors who have to prepare and ship products to many countries. It is quite often that accessories such as power cables, menus, etc. of an electric device may have to be changed when a product prepared for one country is to be shipped to another country. If a distributor decides to open a packaging set in order to change the required accessories, the cushion block and carton of the packaging set or even the electric device packed inside may get damaged during the repackaging process. Such damage is very unwelcome because it incurs a lot of unnecessary costs and efforts, and shipment of the products may also be delayed. Such packaging damages caused by repackaging processes are really a headache to many electric device vendors.

SUMMARY OF THE INVENTION

It is therefore the goal of the present invention, by overcoming the limits of the prior art, to devise a new packaging set for packing an electric device and its accessories which allows easy replacement of the accessories without damaging the packaging set or the electric device.

Briefly, in a preferred embodiment, the present invention includes a packaging set for packing an electric device comprising:

(1) a substantially rectangular cushion block for packing and protecting the electric device;

(2) a substantially rectangular carton having four vertical side panels a sealed bottom end, and an opened top end tightly packed outside the cushion block for protecting the cushion block;

(3) four side flaps flexibly connected to the four vertical side panels of the carton for sealing the top end of the carton;

(4) one packing slot installed in the cushion block having a slot opening facing one side panel of the carton for packing accessories of the electric device; and (5) an L-shaped side cover having an upper flap and a side board connected to on the carton for sealing the slot opening of the packing slot, the side board of the side cover being created by perforating part of said side panel faced the slot opening of the packing slot and the upper flap of the side cover being created by perforating part of the side flap connected to said side panel;

wherein said side flap which comprises the upper flap of the side cover is folded under one adjacent side flap when the top end of the carton is sealed by the four side flaps.

It is an advantage of the present invention that the side cover of the carton can easily be opened and closed for replacing the accessories stored in the packing slot and no damage will be made over the packaging set or the electric device packed inside.

These and other objects and the advantages of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
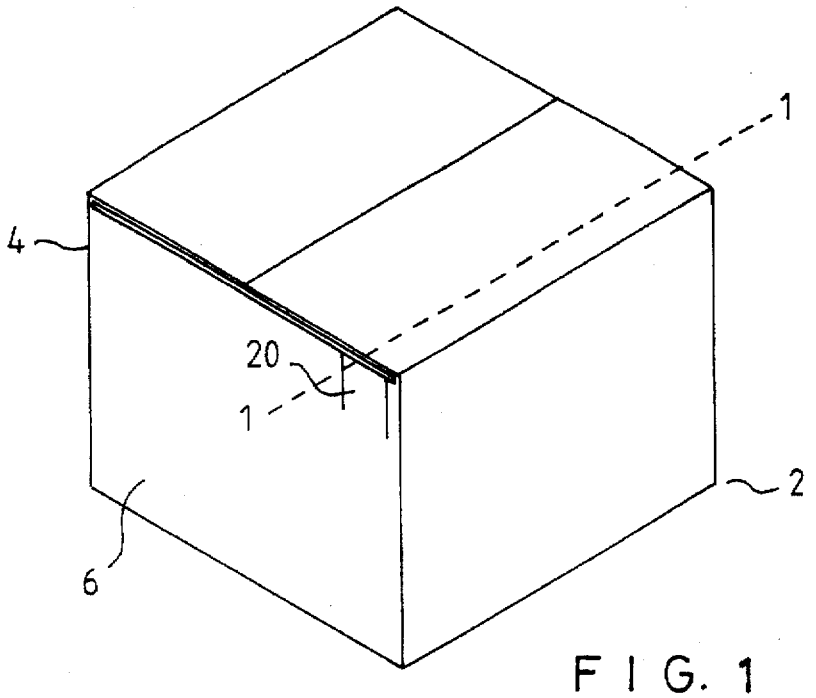
FIG. 1 is a perspective view of a packaging set according to the present invention.
Figure 2:
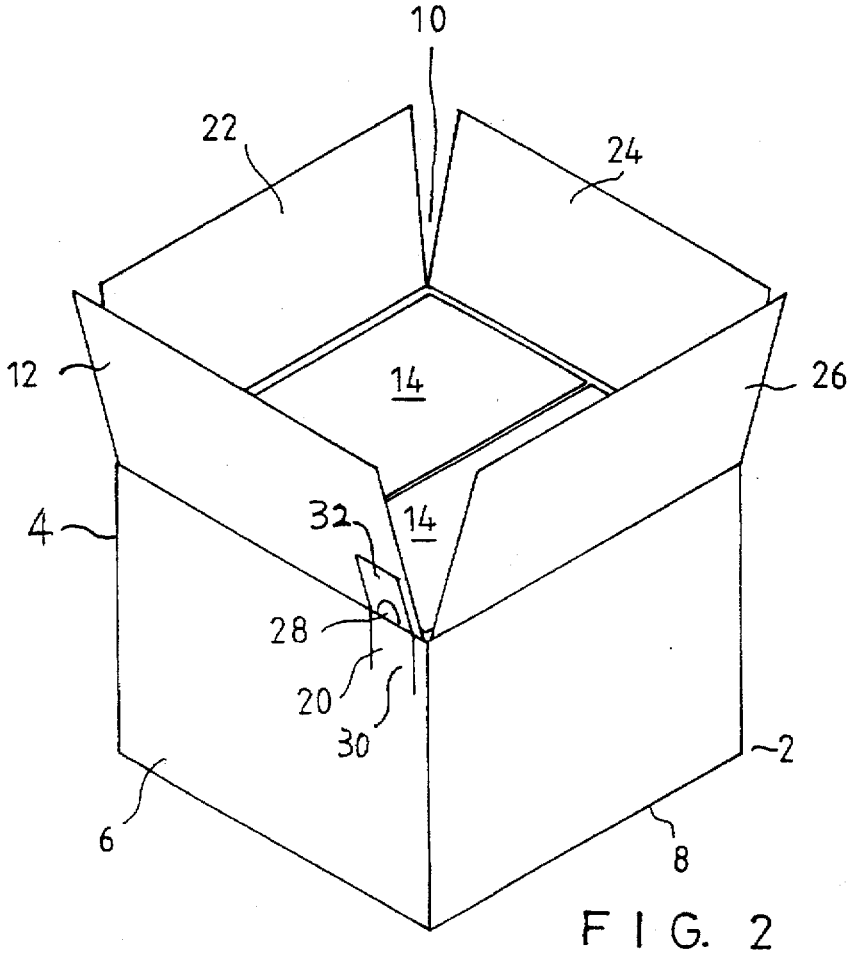
FIG. 2 is a perspective view of the packaging set shown in FIG. 1 with an opened top end.

Please refer to FIG. 1 and FIG. 2. FIGS. 1 and 2 show the perspective views of a packaging set 2 with its top end closed and opened. FIG. 2 shows that the packaging set 2 comprises a substantially rectangular cushion block 14 which comprises two matching pieces for packing and protecting an electric device (not shown) packed in between, a substantially rectangular paper carton 4 tightly packed outside the cushion block 14 for protecting the cushion block 14. The carton 4 comprises four vertical side panels 6, a sealed bottom end 8, an opened top end 10, and four side flaps 12, 22, 24 and 26 connected to the upper ends of the four vertical side panels 6 for sealing the top end 10 of the carton 4. FIG. 1 shows that the top end of the carton 4 is sealed by folding the four side flaps over the upper end of the cushion block 14 packed inside.

Figure 3:
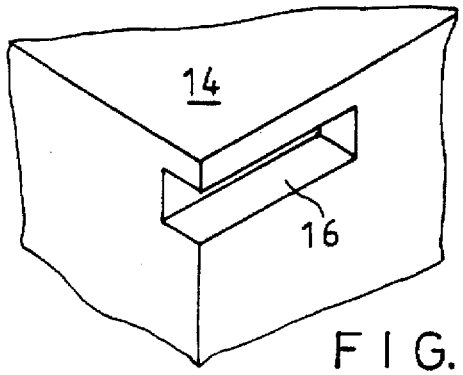
FIG. 3 is a perspective view of part of the cushion block shown in FIG. 2 with a packing slot.
Figure 4:
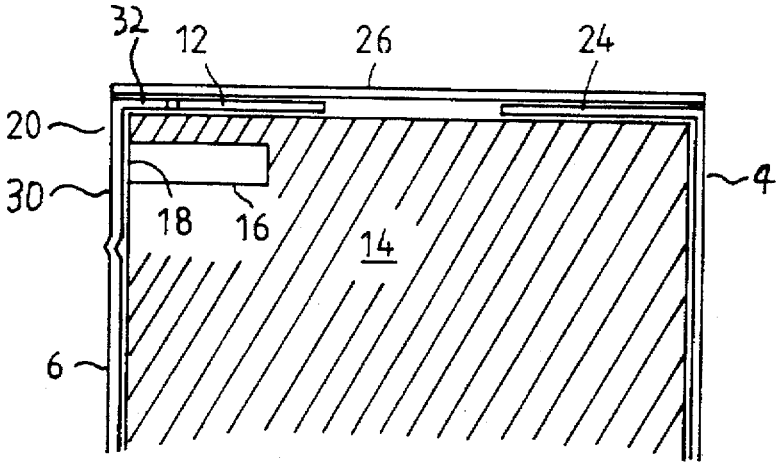
FIG. 4 is a sectional view 1—1 of the packaging set shown in FIG. 1.
Figure 5:
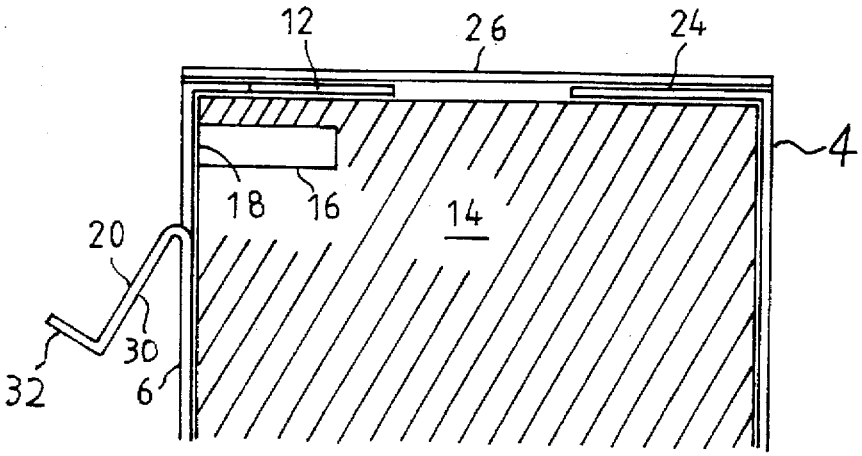
FIG. 5 is a sectional view of the packaging set shown in FIG. 4 with the L-shaped cover opened.

Please refer to FIGS. 3 to 5. FIG. 3 is a perspective view of part of the cushion block 14 shown in FIG. 2 with a packing slot 16 installed for packing accessories of the electric device, FIG. 4 is a sectional view 1—1 of the packaging set 2 shown in FIG. 1 and FIG. 5 is another sectional view of the packaging set 2 with an opened L-shaped cover 20. The packing slot 16 installed in the cushion block 14 has a slot opening 18 facing one side panel 6 of the carton 4, and the carton 4 comprises an L-shaped side cover 20 having an upper flap 32 and a side board 30 connected to the carton 4 for sealing the slot opening 18 of the packing slot 16.

Please refer to FIG. 2 to see how the side cover 20 is created. The side board 30 of the side cover 20 is created by perforating part of the side panel 6 faced by the slot opening 18 and the upper flap 32 of the side cover 20 is created by perforating part of the side flap 12. The upper flap 32 of the side cover 20 further comprises a perforated hole 28 which is used to facilitate finger pulling of the side cover 20. When the top end 10 of the carton 4 is sealed by folding the four side flaps 12, 22, 24 and 26 over the cushion block 14, the side flap 12 which comprises the upper flap 32 of the side cover 20 is folded under the adjacent side flap 26.

A user can use one finger to break the perforation around the hole 28 and then pull out the whole side cover 20 to break the perforation of the side cover 20. When the accessories stored in the packing slot 16 are changed by the user, he/she can close the side cover 20 by inserting the upper flap 32 of the side cover 20 under the adjacent side flap 26 so that the upper flap 32 can be clamped between the side flap 26 and the cushion block 14 again. Such design allows repeatedly open and close of the side cover 20 without damaging the packaging set 2 and the electric device packed inside.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A packaging set for packing an electric device comprising:

(1) a substantially rectangular cushion block for packing and protecting the electric device;

(2) a substantially rectangular carton having four vertical side panels, a sealed bottom end, and an opened top end tightly packed outside the cushion block for protecting the cushion block;

(3) four side flaps flexibly connected to the four vertical side panels of the carton for sealing the top end of the carton;

(4) one packing slot installed in the cushion block having a slot opening facing one side panel of the carton for packing accessories of the electric device; and (5) an L-shaped side cover having an upper flap and a side board connected to the carton for sealing the slot opening of the packing slot, the side board of the side cover being created by perforating part of said side panel faced the slot opening of the packing slot and the upper flap of the side cover being created by perforating part of the side flap connected to said side panel;

wherein said side flap which comprises the upper flap of the side cover is folded under one adjacent side flap when the top end of the carton is sealed by the four side flaps.

2. The packaging set of claim 1 wherein the upper flap of the side cover further comprises a perforated hole for facilitating finger pulling of the side cover.

* * * * *